US007322571B2

(12) United States Patent
Springer

(10) Patent No.: US 7,322,571 B2
(45) Date of Patent: Jan. 29, 2008

(54) BAR CLAMP

(75) Inventor: Scott D. Springer, Westmont, IL (US)

(73) Assignee: Adjustable Clamp Company, Chicago, IL (US)

( * ) Notice: Subject to any disclaimer, the term of this patent is extended or adjusted under 35 U.S.C. 154(b) by 161 days.

(21) Appl. No.: 11/287,025

(22) Filed: Nov. 23, 2005

(65) Prior Publication Data

US 2007/0114708 A1 May 24, 2007

(51) Int. Cl.
*B25B 5/16* (2006.01)
*B25B 5/00* (2006.01)

(52) U.S. Cl. ..... 269/6; 269/43

(58) Field of Classification Search ..... 269/6, 269/3, 43, 88, 166, 147–149, 152–155, 203, 269/257, 906
See application file for complete search history.

(56) References Cited

U.S. PATENT DOCUMENTS 1,484,794 A * 2/1924 Moses ..... 269/149
1,783,713 A 12/1930 Holman
2,636,527 A 4/1953 Schlemann
2,778,393 A * 1/1957 Golasowski ..... 269/63
4,607,829 A * 8/1986 Suska ..... 269/88
4,825,513 A * 5/1989 Verespej ..... 24/135 N
4,926,722 A 5/1990 Sorensen et al.
5,005,449 A 4/1991 Sorensen et al.
5,094,131 A 3/1992 Sorensen et al.
5,222,420 A 6/1993 Sorensen et al.
5,454,551 A 10/1995 Hobday
5,529,297 A 6/1996 Sawdon
5,595,378 A * 1/1997 Martinsson et al. ..... 269/210
5,893,551 A * 4/1999 Cousins et al. ..... 269/43
6,039,313 A 3/2000 Baculy
6,089,556 A 7/2000 Whiteford
6,338,478 B2 1/2002 Baculy
6,367,787 B1 4/2002 Poole et al.
6,382,608 B1 5/2002 Michell
6,386,530 B1 5/2002 Marks
6,402,131 B1 6/2002 Baculy
6,530,565 B1 3/2003 Simpson
6,655,670 B1 12/2003 Liou
6,685,176 B2 2/2004 Wirth, Jr. et al.
6,860,179 B2 3/2005 Hopper et al.
6,889,966 B2 5/2005 Wirth, Jr.
6,929,253 B2 8/2005 Marks
7,066,457 B2 * 6/2006 Gerritsen et al. ..... 269/6

(Continued)

FOREIGN PATENT DOCUMENTS

DE 3209984 A1 * 5/1983

(Continued)

*Primary Examiner*—David B Thomas
(74) *Attorney, Agent, or Firm*—Cook, Alex, McFarron, Manzo, Cummings & Mehler, Ltd.

(57) ABSTRACT

A clamp is adapted to be secured to a second substantially identical clamp in order to accommodate a larger workpiece than can be held by a single clamp. The clamp includes a first jaw that is secured to an intermediate member, such as a bar or pipe, and a second jaw that is removeably securable to the intermediate member so as to selectively oppose the first jaw. The second jaw includes a surface thereon that is configured to interlock with a complimentarily-shaped surface on a second jaw of the second clamp.

15 Claims, 2 Drawing Sheets

U.S. PATENT DOCUMENTS

| | | | | |
|---|---|---|---|---|
| 7,159,858 | B2 * | 1/2007 | Ben-Gigi | 269/6 |
| 2001/0006270 | A1 | 7/2001 | Baculy | |
| 2003/0005797 | A1 | 1/2003 | Hopper et al. | |
| 2004/0113344 | A1 | 6/2004 | Wirth, Jr. et al. | |
| 2004/0121887 | A1 | 6/2004 | Allen | |
| 2005/0156368 | A1 | 7/2005 | Fuller | |
| 2005/0236753 | A1 * | 10/2005 | Ben-Gigi | 269/6 |

FOREIGN PATENT DOCUMENTS

| | | | |
|---|---|---|---|
| DE | 89 03 875 | | 2/1990 |
| DE | 102 42 799 | A1 | 3/2004 |
| EP | 74487 | A2 * | 3/1983 |
| FR | 2 667 813 | A1 | 4/1992 |
| WO | WO 86/01763 | | 3/1986 |

* cited by examiner

FIG. 3
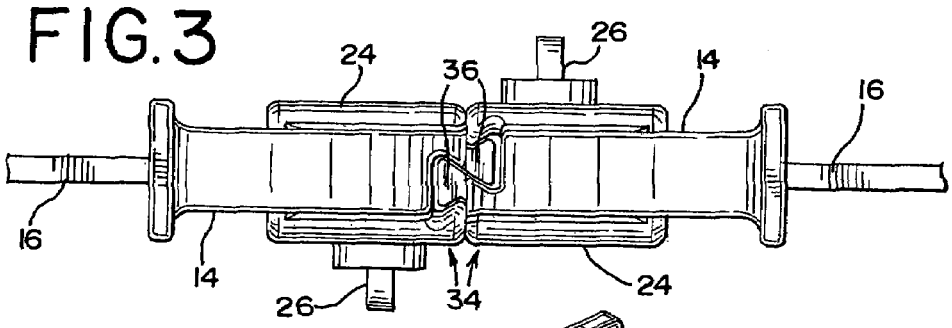
FIG. 7
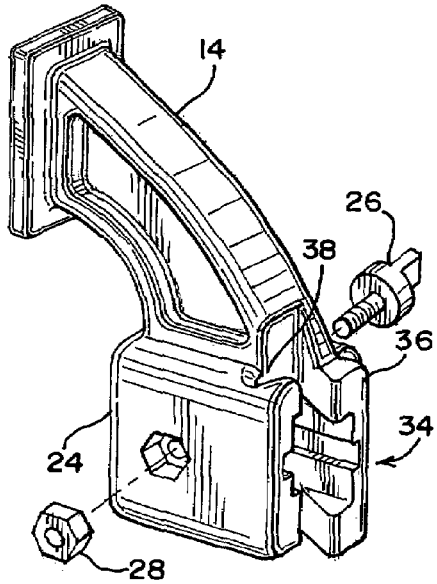
FIG. 4
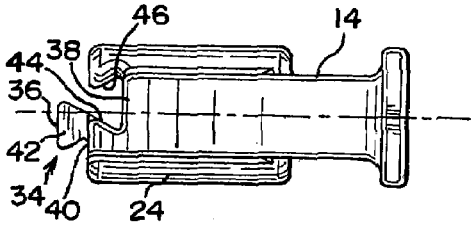
FIG. 5
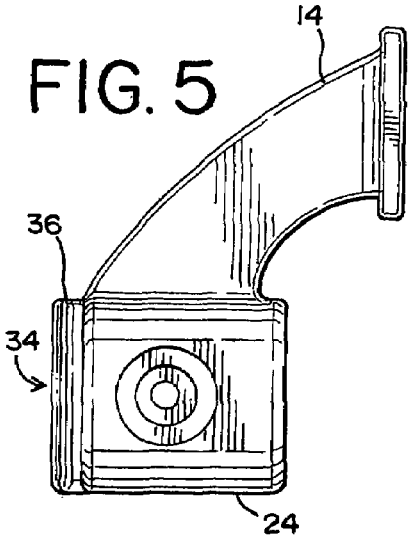
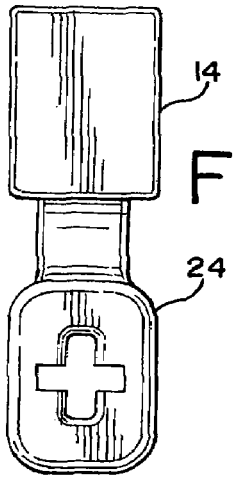
FIG. 6

BAR CLAMP

BACKGROUND OF THE INVENTION

Bar clamps are among the most widely used fixtures by craftsmen and woodworkers. Bar clamps typically include a first "fixed jaw" secured in place on a bar or pipe and a second moveable jaw secured to the bar or pipe in opposition to the first jaw. See, e.g. U.S. Pat. No. 1,783,713 (showing a bar clamp) and U.S. Pat. No. 6,338,478 (showing pipe clamp).

Selecting the appropriate bar clamp for a particular job depends upon the size of the work piece to be held. Bar clamps are typically available in lengths ranging from 6 inches to 8 feet, and it is not unusual for a tradesman to have a large number of bar or pipe clamps in varying lengths in order to be prepared for most contingencies. Most hobbyists and do-it-yourselfers, however, are unlikely to own bar clamps in the many varying lengths available, and are thus more likely to encounter situations where a clamp is needed with a larger space between the fixed and moveable jaws than is at hand.

Accordingly, it is an object of the present invention to provide a bar clamp which can be joined to a similarly configured bar clamp to increase the working distance between the jaw members on the clamp.

SUMMARY OF THE INVENTION

This object, and others which will become apparent upon reference to the following detailed description and accompanying drawings, is provided by a clamp that is adapted to be secured to a second substantially identical clamp. The clamp includes a first jaw that is secured to an intermediate member, such as a bar or pipe, and a second jaw that is removably securable to the intermediate member so as to selectively oppose the first jaw. The second jaw includes a surface thereon that is configured to interlock with a complimentarily-shaped surface on a second jaw of the second clamp.

Preferably, the surface of the second jaw comprises a projection substantially on a first side of a center line of the second jaw and a complimentarily-shaped recess substantially on a second side of the center line. The projection and the recess are configured so that the surface on the second jaw interlocks with an identically-configured second jaw of a second clamp. Preferably, the projection is symmetrical in shape, and has a narrow neck portion with a relatively larger head portion. The recess is also symmetrical in shape with a narrow mouth and a relatively larger interior. The head portion of the projection is larger then the mouth portion of the recess. The projection and recess may be in any of a number of shapes, such as dove tail-shaped, T-shaped, and ball-shaped.

BRIEF DESCRIPTION OF THE DRAWINGS

FIG. 3 is a bottom view of the interconnected jaw members of the two bar clamps shown in FIG. 2.

FIG. 4 is a top view of a fixed jaw in accordance with the present invention.

FIG. 5 is a plan view of a fixed jaw in accordance with the present invention.

FIG. 6 is a side view of a fixed jaw in accordance with the present invention.

FIG. 7 is a perspective view of a fixed jaw in accordance with the present invention.

DETAILED DESCRIPTION OF THE PREFERRED EMBODIMENT

Figure 1:
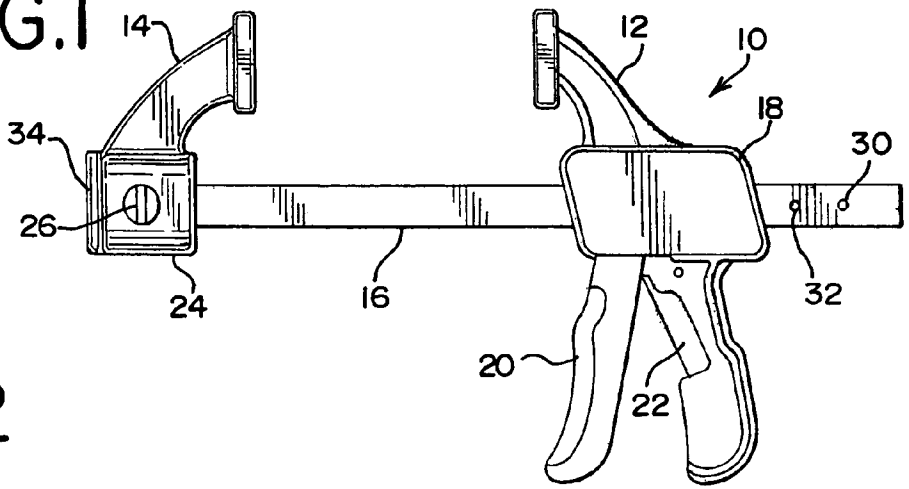
FIG. 1 is a plan view of a bar clamp in accordance with the present invention.
Figure 2:
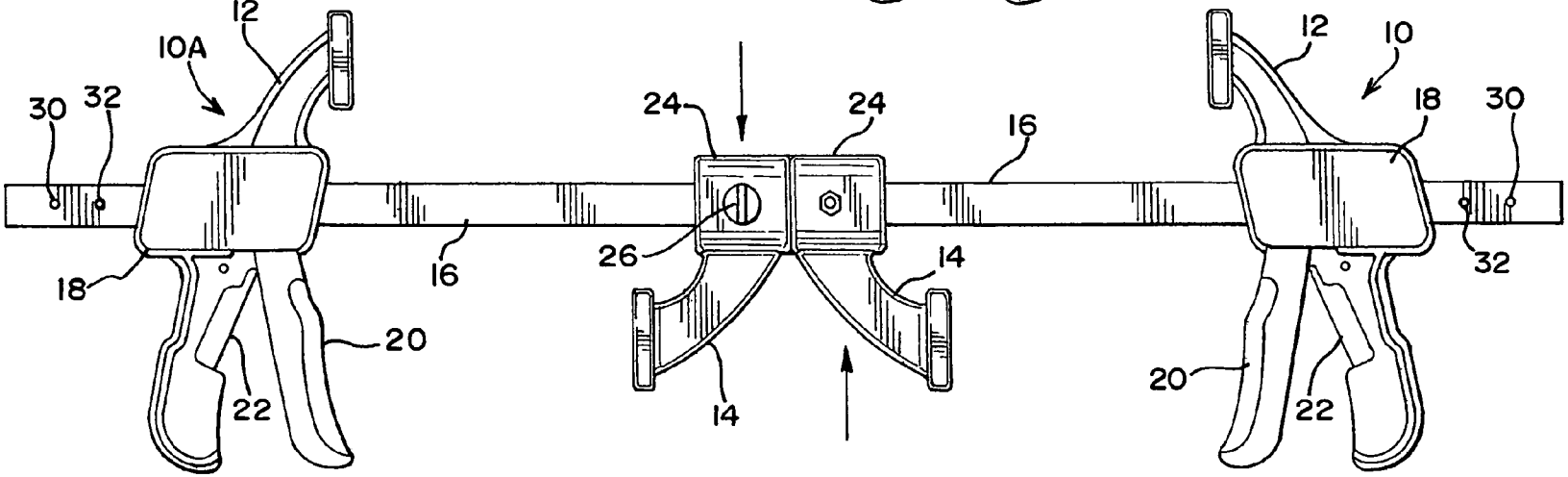
FIG. 2 is a plan view of a first bar clamp according to the present invention connected to a second bar clamp according to the present invention, thereby extending the working length of the bar clamp.

Turning to FIGS. 1 and 2, there is seen a bar clamp, generally designated 10, that can be joined to a second bar clamp, generally designated 10A, having a configuration substantially identical to the bar clamp 10 to permit the user to create a bar clamp adapted for use with larger work pieces, as shown in FIG. 2.

The clamps 10, 10A each include a moveable jaw 12 and a fixed jaw 14, both of which are received on a slide bar 16. The moveable jaw 12 is formed integrally with a handle/grip assembly 18 that includes a first operating handle 20 for incrementally advancing the moveable jaw 12 along the slide bar 16 toward the fixed jaw 14, and a second operating handle 22 for releasing the slide bar 16 so that the moveable jaw 12 can freely slide away from the fixed jaw 14, as is well known in the art. An internal mechanism for the handle/grip assembly 18 may be as shown in U.S. Pat. No. 6,655,670, which is incorporated here and by reference.

The fixed jaw 14 includes a sleeve portion 24 that receives the slide bar 16 so that the fixed jaw 14 may be removably secured to the slide bar 16 by means of a thumb screw 26 and a nut 28. The shank of the screw 26 is received in a hole 30 adjacent the end of the slide bar 18.

The clamp 10 as shown in FIG. 1, is configured for holding a work piece between the two opposed jaw 12, 14. The removeability of the fixed jaw 14 allows the clamp 10 to be reconfigured for use as a spreader. To this end, the fixed jaw 14 is removed from the first end of the slide bar 16, the handle/grip assembly 18 is moved toward the first end of the slide bar 16, and the fixed jaw 14 is secured to the second end of the slide bar so that its jaw faces away from the jaw 12 on the handle/grip assembly 18. Thus, the slide bar 16 includes a hole 30 adjacent each end to facilitate selectively securing the fixed jaw 14 to either end. In the preferred embodiment, each end of the slide bar also includes a stop 32 that extends transversely beyond the face of the slide bar 16 for keeping the handle/grip 18 assembly associated with the slide bar 16.

In keeping with the invention, the sleeve 24 of the fixed jaw 14 is formed with a surface, generally designated 34, that is configured to interlock with a similar surface on the fixed jaw of a second bar clamp, thus permitting the user to create an extended bar clamp as shown in FIG. 2.

As best seen in FIGS. 3, 4 and 7, the surface 34 comprises a projection 36 and a complementarily-shaped recess 38. When viewed from above, as soon in FIG. 3, projection 36 is symmetrical in shape and comprises a narrow neck portion 40 and a relatively larger head portion 42. The recess 38 is similarly symmetrical in shape and has a narrow mouth portion 44 with a relatively larger interior 46. As can be appreciated, the head 42 of the projection 36 is larger than the mouth 44 of the recess 38 so that two interlocked fixed jaws 14 will resist separation when a clamping force is exerted in a direction of the longitudinal axis of the slide bar 16, but can slide apart if a force is exerted perpendicular to the axis of the slide bar. In the illustrated fix jaws, the projections and recesses are dovetail-shaped. However, they can also be T-shaped or ball-shaped without departing from the invention.

Consequently, a pair of bar clamps 10, 10A of the type described above can be joined together by first removing the fixed jaws 14 from their respective slide bars 16. The fixed jaws 14 are then rotated 180 degrees about the axes of their respective slide bars 16 and then reattached thereto so that the jaw of the fixed jaw 14 is on the opposite side of the slide bar 16 from the jaw on the moveable jaw 12. The interlocking surfaces 34 of the fixed jaws 14 are joined together in a sliding motion, as indicated by the arrows in FIG. 2, so that the fixed jaws 14 interlock and the moveable jaws 12 of the bar clamps 10, 10A are in opposition so that a work piece can be secured therebetween.

Thus, a bar clamp configuration meeting all of the objects of the present invention has been provided. While the invention has been described in terms of a preferred embodiment, there is no intent to limit it to the same. Instead, it is intended to cover variations that would be apparent to a person having ordinary skill in the art. For example, while the clamp has been described as having a slide bar to which the moveable and fixed jaws are mounted, other structural members could be used to support the jaws, such as pipes, rods and bars of various cross-sectional shape, without departing from the invention.

What is claimed:

1. A clamp adapted to be secured to a second substantially identical clamp comprising:

a first jaw secured to an intermediate member; and a second jaw removably securable to the intermediate member so as to selectively oppose the first jaw, and the second jaw having a surface thereon configured to interlock with a complementarily-shaped surface on a second jaw of the second clamp.

2. The clamp of claim 1 wherein the surface of the second jaw comprises a projection substantially on a first side of a centerline of the second jaw and a complementarily-shaped recess substantially on a second side of the centerline, the projection and recess being configured so that the surface on the second jaw may interlock with an identically-configured second jaw of a second clamp.

3. The clamp of claim 2 wherein the projection is symmetrical in shape and comprises a narrow neck portion and a relatively larger head portion, the recess is symmetrical in shape with a narrow mouth and a relatively larger interior, and the head portion of the projection being larger than the mouth portion of the recess.

4. The clamp of claim 3 wherein the projection and the recess are dovetail-shaped.

5. The clamp of claim 4 wherein the projection and the recess are T-shaped.

6. The clamp of claim 3 wherein the head portion of the projection and the interior of the recess are ball-shaped.

7. The clamp of claim 1 wherein the first jaw is slidably received on the intermediate member.

8. The clamp of claim 1 wherein the intermediate member comprises a bar.

9. The clamp of claim 1 wherein the intermediate member comprises a pipe.

10. A bar clamp comprising:

an elongated bar;

a movable jaw slidably received on the bar; and a second jaw removably securable to the bar, and having a surface thereon configured to interlock with a complementarily-shaped surface on a second jaw of a second bar clamp.

11. The bar clamp of claim 10 wherein the surface of the second jaw comprises a projection substantially on a first side of a centerline of the second jaw and a complementarily-shaped recess substantially on a second side of the centerline, the projection and recess being configured so that the surface on the second jaw may interlock with an identically-configured second jaw of a second bar clamp.

12. The bar clamp of claim 11 wherein the projection is symmetrical in shape and comprises a narrow neck portion and a relatively larger head portion, the recess is symmetrical in shape with a narrow mouth and a relatively larger interior, the head portion of the projection being larger than the mouth portion of the recess.

13. The bar clamp of claim 12 wherein the projection and the recess are dovetail-shaped.

14. The bar clamp of claim 13 wherein the projection and the recess are T-shaped.

15. The bar clamp of claim 12 wherein the head portion of the projection and the interior of the recess are ball-shaped.

* * * * *